US011231036B2

(12) United States Patent
Chiba et al.

(10) Patent No.: US 11,231,036 B2
(45) Date of Patent: Jan. 25, 2022

(54) SCREW COMPRESSOR HAVING AN OPENING OF A FLUID SUPPLY PORTION BETWEEN THE COMPRESSION INTERSECTION LINE AND A TRAJECTORY LINE

(71) Applicant: Hitachi Industrial Equipment Systems Co., Ltd., Tokyo (JP)

(72) Inventors: Kotaro Chiba, Tokyo (JP); Masahiko Takano, Tokyo (JP); Shigeyuki Yorikane, Tokyo (JP); Kenji Morita, Tokyo (JP); Yoshitaka Takeuchi, Tokyo (JP); Minako Kanada, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 31 days.

(21) Appl. No.: 16/644,052

(22) PCT Filed: Aug. 6, 2018

(86) PCT No.: PCT/JP2018/029337
§ 371 (c)(1),
(2) Date: Mar. 3, 2020

(87) PCT Pub. No.: WO2019/044390
PCT Pub. Date: Mar. 7, 2019

(65) Prior Publication Data

US 2020/0386229 A1 Dec. 10, 2020

(30) Foreign Application Priority Data

Sep. 4, 2017 (JP) ..... JP2017-169138

(51) Int. Cl.
*F04C 18/16* (2006.01)
*F04C 29/02* (2006.01)
(Continued)

(52) U.S. Cl.
CPC ..... *F04C 18/16* (2013.01); *F04C 29/0007* (2013.01); *F04C 29/02* (2013.01);
(Continued)

(58) Field of Classification Search
CPC ..... F04C 29/0007; F04C 29/02–028; F04C 18/16; F04C 2/16; F01C 1/16; F01C 21/001; F01C 21/04–045
See application file for complete search history.

(56) References Cited

U.S. PATENT DOCUMENTS 3,138,320 A * 6/1964 Schibbye ..... F04C 29/0007 418/99
3,820,923 A 6/1974 Zweifel
(Continued)

FOREIGN PATENT DOCUMENTS

DE 27 20 214 A1 12/1977
EP 2 863 060 A1 4/2015
(Continued)

OTHER PUBLICATIONS

Extended European Search Report issued in European Application No. 18851421.0 dated Nov. 25, 2020 (eight(8) pages).
(Continued)

*Primary Examiner* — Laert Dounis
(74) *Attorney, Agent, or Firm* — Crowell & Moring LLP

(57) ABSTRACT

A screw compressor includes a screw rotor, a casing, and a fluid supply portion to supply fluid in a membrane form into a compression chamber in the casing. The screw rotor has a male and female rotors. A male bore covering the male rotor and a female bore covering the female rotor are formed on the inner surface of the casing. An intersection line, on a higher pressure side, of the male and female bores is defined as a compression cusp. In a bore development view, a trajectory made by the first intersection of an extension line
(Continued)

of a female lobe ridge and a male lobe ridge being moved, along with the rotation of the male and female rotors, is defined as a trajectory line. An opening of the fluid supply section to the compression chamber is positioned between the compression cusp and the trajectory line.

7 Claims, 6 Drawing Sheets

(51) Int. Cl.
*F04C 29/00* (2006.01)
*F04C 29/04* (2006.01)

(52) U.S. Cl.
CPC ..... *F04C 29/028* (2013.01); *F04C 29/042* (2013.01); *F04C 2240/20* (2013.01); *F04C 2240/30* (2013.01); *F04C 2240/50* (2013.01)

(56) References Cited

U.S. PATENT DOCUMENTS

| | | | |
|---|---|---|---|
| 5,653,585 | A | 8/1997 | Fresco |
| 2012/0171069 | A1 | 7/2012 | Huang et al. |

FOREIGN PATENT DOCUMENTS

| | | | | |
|---|---|---|---|---|
| JP | 45-19671 | B2 | | 7/1970 |
| JP | 48-64509 | A | | 9/1973 |
| JP | 52-135407 | A | | 11/1977 |
| JP | 58-8288 | A | | 1/1983 |
| JP | 2001153073 | A | * | 6/2001 |
| JP | 2003-184768 | A | | 7/2003 |
| JP | 2015-78623 | A | | 4/2015 |

OTHER PUBLICATIONS

Japanese language Office Action issued in Japanese Application No. 2017-169138 dated Dec. 8, 2020 with English translation (eight (8) pages).

International Search Report (PCT/ISA/210) issued in PCT Application No. PCT/JP2018/029337 dated Sep. 11, 2018 with English translation (five (5) pages).

Japanese-language Written Opinion (PCT/ISA/237) issued in PCT Application No. PCT/JP2018/029337 dated Sep. 11, 2018 (four (4) pages).

Taiwanese-language Office Action issued in counterpart Taiwanese Application No. 107130559 dated Apr. 19, 2019 (five (5) pages).

* cited by examiner

SCREW COMPRESSOR HAVING AN OPENING OF A FLUID SUPPLY PORTION BETWEEN THE COMPRESSION INTERSECTION LINE AND A TRAJECTORY LINE

TECHNICAL FIELD

The present invention relates to a screw compressor.

BACKGROUND ART

There are screw compressors having a function of supplying fluid from outside to the inside of a compression chamber. The purpose of supplying fluid is to seal a clearance inside the compression chamber, cool the gas during the compression process, lubricate sliding male and female rotors, and the like.

One of conventional techniques for spraying fluid into a compressor is a technique of forming water supply portions on a casing wall corresponding to a compression working chamber to spray water from the water supply portions into the compression working chamber. In this conventional technique, small holes are formed in the bottom of each of the water supply portions, inclined at an angle of θ with respect to the axis of the hole, to communicate with the outside, so that water guided to the blind hole is sprayed from the small holes into the compression working chamber over a wide range. Patent Document 1 discloses an example of such a conventional technique.

PRIOR ART DOCUMENTS

Patent Documents

Patent Document 1: Japanese Patent Application Publication No. 2003-184768

SUMMARY OF THE INVENTION

Problems to be Solved

In a screw compressor using the above-described conventional technique, the water sprayed from the small holes of the water supply portion spreads over a wide range in the compression working chamber. Here, the water sprayed from the inclined small holes spreads in a membrane form after colliding with each other, and then is atomized. Accordingly, it requires a certain distance before the water sprayed from the water supply portion is atomized through a state of being water membrane.

However, the distance until the water being atomized is limited because there is a rotating screw rotor ahead in the direction of the water being sprayed from the water supply portion. For this reason, when the distance between a lobe bottom of the screw rotor and the water supply portion is short, or when the rotation speed of the screw rotor is high, there is a risk of the water adhering to a surface of the screw rotor without being sufficiently atomized.

SUMMARY OF THE INVENTION

Problem to be Solved

The present invention is intended to sufficiently atomize fluid, supplied from the outside of a screw compressor to a compression chamber via a fluid supply portion, in a shorter distance from the fluid supply portion.

Solution to Problem

A screw compressor according to the present invention solves the above-identified problem and includes a screw rotor and a casing to house the screw rotor. In addition, the screw compressor includes a fluid supply portion to supply fluid in a membrane form into a compression chamber defined in the casing. The screw rotor has a male and female rotors that have twisted lobes and are rotated while meshing with each other. The casing is formed on the inner surface thereof with a male bore in a cylindrical shape to cover the male rotor and a female bore in a cylindrical shape to cover the female rotor. Here, an intersection line, on a higher pressure side, of the male and female bores is defined as a compression intersection line. Additionally, in a bore development view, a trajectory made by the first intersection of an extension line of the lobe ridge of the female rotor and the lobe ridge of the male rotor being moved, along with the rotation of the male and female rotors, is defined as a trajectory line. The bore development view shows the male and female bores developed on a plane. In this case, an opening of the fluid supply portion to the compression chamber is positioned between the compression intersection line and the trajectory line. Alternatively, the fluid supply portion supplies fluid in an atomized form into a compression chamber defined in the casing.

Advantageous Effects of the Invention

The present invention allows fluid supplied from the outside of a screw compressor via a fluid supply portion to a compression chamber to be sufficiently atomized in a shorter distance from the fluid supply portion.

DETAILED DESCRIPTION OF THE EMBODIMENTS

Figure 1:
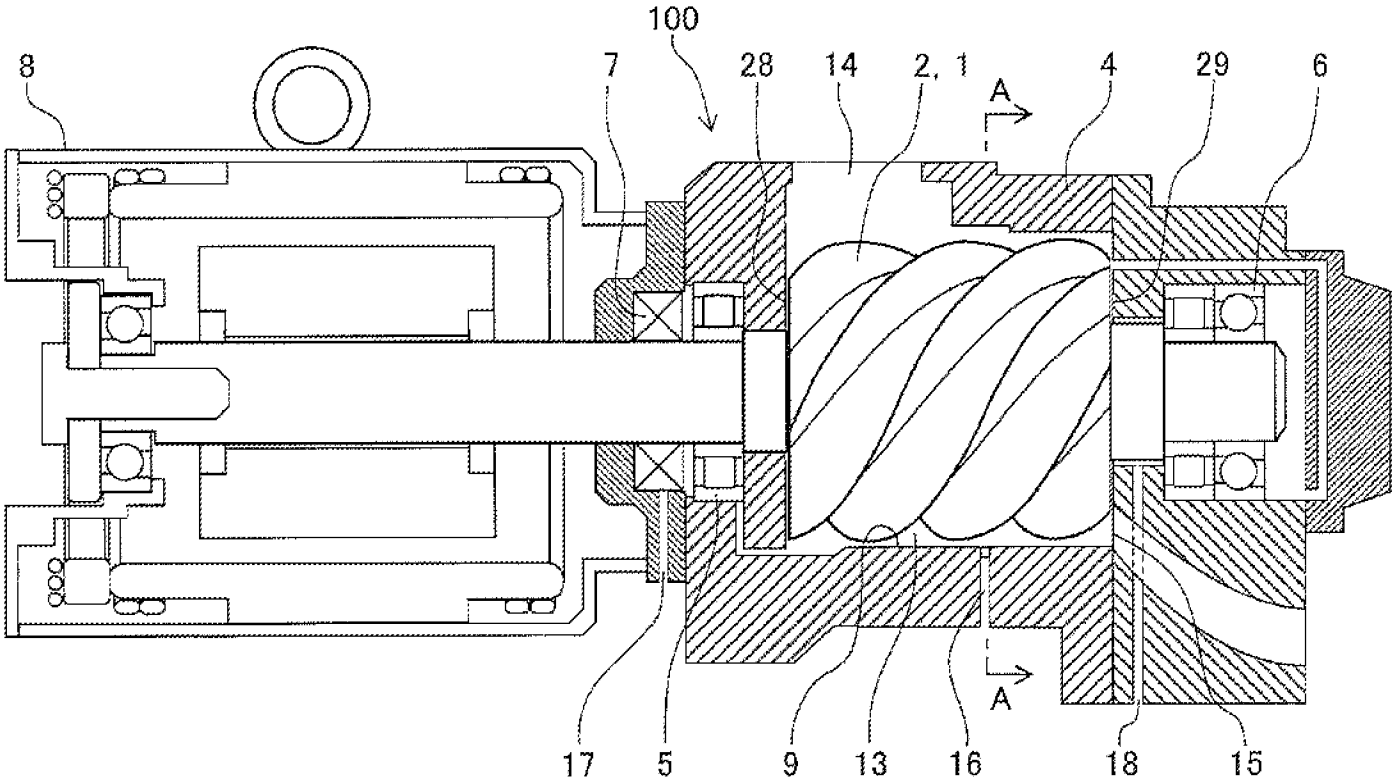
FIG. 1 is a diagram showing a configuration of a screw compressor according to a first embodiment of the present invention.

Embodiments of the present invention are described in detail, with reference to the drawings as required. Note that in the drawings, common components and similar components are denoted by the same reference numerals, and duplicate descriptions thereof are omitted as appropriate.

First Embodiment

Figure 2:
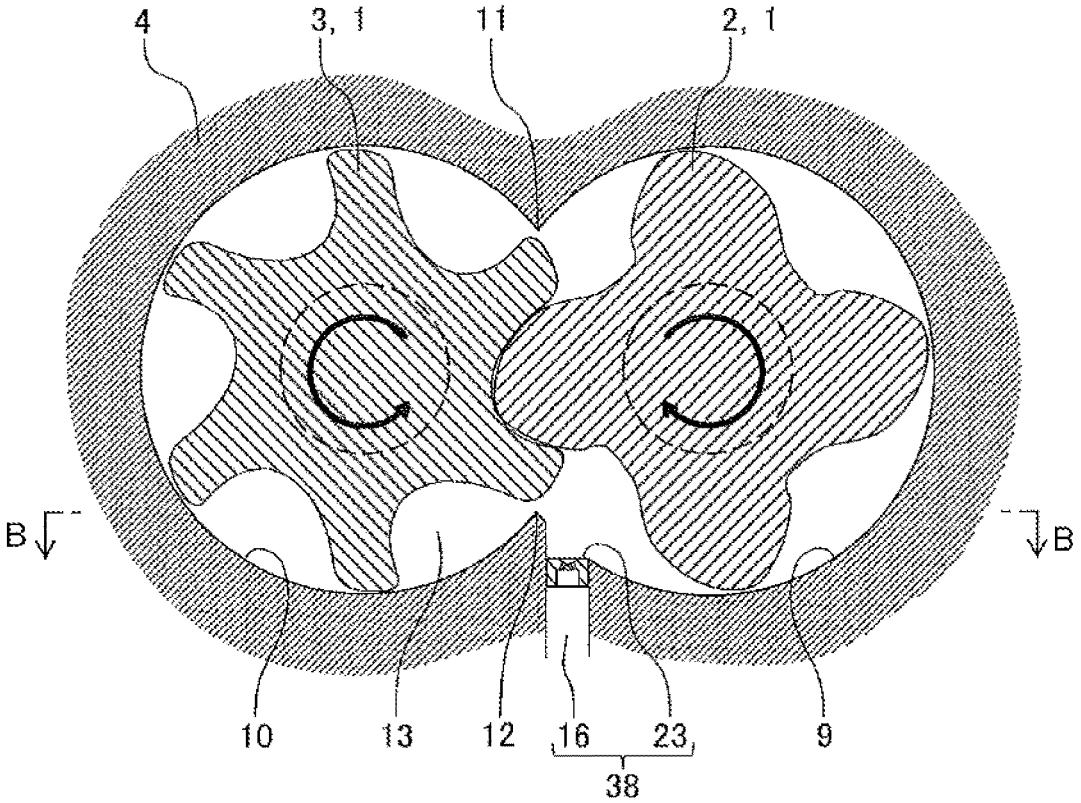
FIG. 2 is a cross-sectional view, taken along a line A-A in FIG. 1, of a screw rotor and the vicinity of a fluid supply portion.

First, a first embodiment of the present invention is described with reference to FIGS. 1 to 6. FIG. 1 is a diagram showing a configuration of a screw compressor 100 according to a first embodiment of the present invention. FIG. 2 is a cross-sectional view, taken along a line A-A in FIG. 1, of a screw rotor 1 and the vicinity of a fluid supply portion 38.

The screw compressor 100 according to the present embodiment includes the screw rotor 1 and a casing 4 to house the screw rotor 1, as shown in FIGS. 1 and 2. The screw rotor 1 has a male rotor 2 and a female rotor 3, which have twisted lobes and are rotated while meshing with each other, and is used as a collective term for these.

In addition, the screw compressor 100 includes a suction bearing 5 and a delivery bearing 6 for rotatably supporting the male rotor 2 and the female rotor 3, respectively, and a shaft sealing member 7 such as an oil seal or a mechanical seal. Here, a "suction" side refers to a side in the axial direction of the screw rotor 1 to suck gas such as air, and a "delivery" side refers to a side in the axial direction of the screw rotor 1 to deliver gas.

Generally, the male rotor 2 has a suction end thereof connected to a motor 8 as a rotary drive source via a rotor shaft. The casing 4 is formed on the inner surface thereof with a male bore 9 in a cylindrical shape to cover the male rotor 2 and a female bore 10 in a cylindrical shape to cover the female rotor 3. The male rotor 2 and the female rotor 3 are respectively housed in the casing 4 with a clearance of several tens to several hundreds μm from the male bore 9 and female bore 10 of the casing 4. There are two intersection lines of the male bore 9 and the female bore 10, where a lower pressure intersection line is defined as a suction cusp 11 and a higher pressure intersection line is defined as a compression cusp (compression intersection line) 12.

The male rotor 2 rotationally driven by the motor 8 rotationally drives the female rotor 3, to expand and contract a compression chamber 13 defined by grooves of the male rotor 2 and female rotor 3, and the male bore 9 and female bore 10 surrounding the rotors. This makes gas such as air be sucked through a suction port 14, be compressed to a predetermined pressure, and then be delivered through the delivery port 15.

In addition, fluid is injected to the compression chamber 13, the suction bearing 5, the delivery bearing 6, and the shaft sealing member 7 from the outside of the screw compressor 100 through a fluid supply hole 16, a suction bearing fluid supply hole 17, and a delivery bearing fluid supply hole 18.

Figure 3:
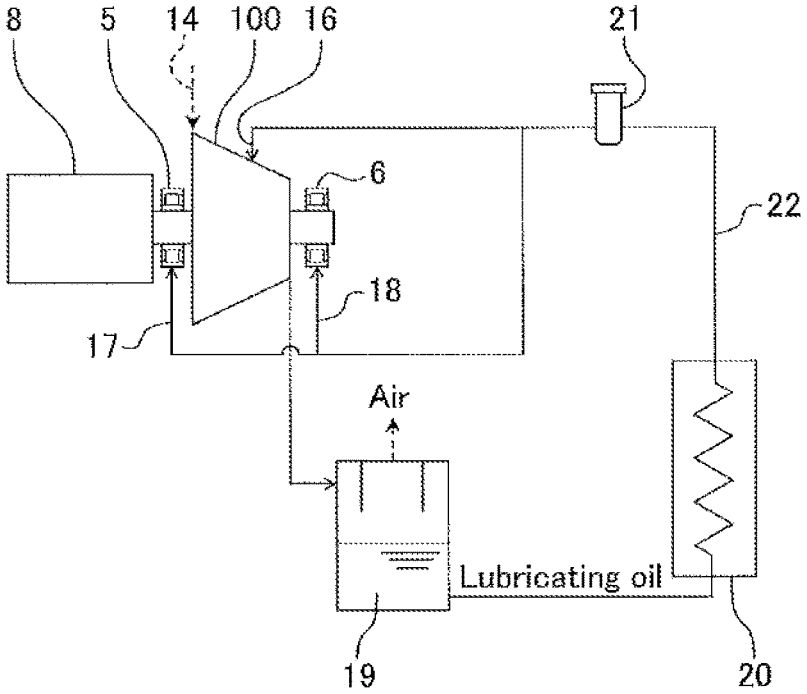
FIG. 3 is a schematic diagram of a supply path for fluid supplied to the screw compressor.

FIG. 3 is a schematic diagram of a supply path for fluid supplied to the screw compressor 100. The supply path for fluid is composed of the screw compressor 100, a centrifuge 19, a cooler 20, auxiliary devices 21 such as a filter and a check valve, and piping 22 connecting them, as shown in FIG. 3. The fluid injected from outside into the screw compressor 100 is mixed in the compressed gas delivered from the screw compressor 100. The fluid mixed in the compressed gas is separated from the compressed gas by the centrifuge 19, cooled by the cooler 20, then branched via the auxiliary devices 21 and supplied again to the respective parts. That is, the branched fluid is delivered through the fluid supply hole 16 to the compression chamber 13 in the screw compressor 100, through the suction bearing fluid supply hole 17 to the shaft sealing member 7 and the suction bearing 5, and through the delivery bearing fluid supply hole 18 to the delivery bearing 6. Note that the branch points of the supply path for fluid are not limited to those provided outside the screw compressor 100 as shown in FIG. 3, and also include those provided inside the casing 4 of the screw compressor 100.

The present embodiment of the screw compressor 100 as described above is made to spray fluid supplied into the compression chamber 13 from the outside of the screw compressor 100 over a wide range in the compression chamber 13, to improve effect of cooling the compressed gas, and the like.

Next, a description is given in more detail of a structure in the present embodiment to supply fluid into the compression chamber 13 from the outside of the screw compressor 100. In the present embodiment, the screw compressor 100 is a screw air compressor to compress air, and fluid supplied from outside into the compression chamber 13 is lubricating oil. Hereinafter, a case is described where an object to be compressed is air and lubricating oil is supplied into the compression chamber 13.

As shown in FIG. 2, a jet impingement nozzle 23 is provided in the vicinity of a communication portion between the fluid supply hole 16 and the compression chamber 13. The jet impingement nozzle 23 is provided such as by press-fitting, screwing, or processing after integral molding. The fluid supply hole 16 and the jet impingement nozzle 23 compose the fluid supply portion 38 to supply fluid into the compression chamber 13.

Figure 4:
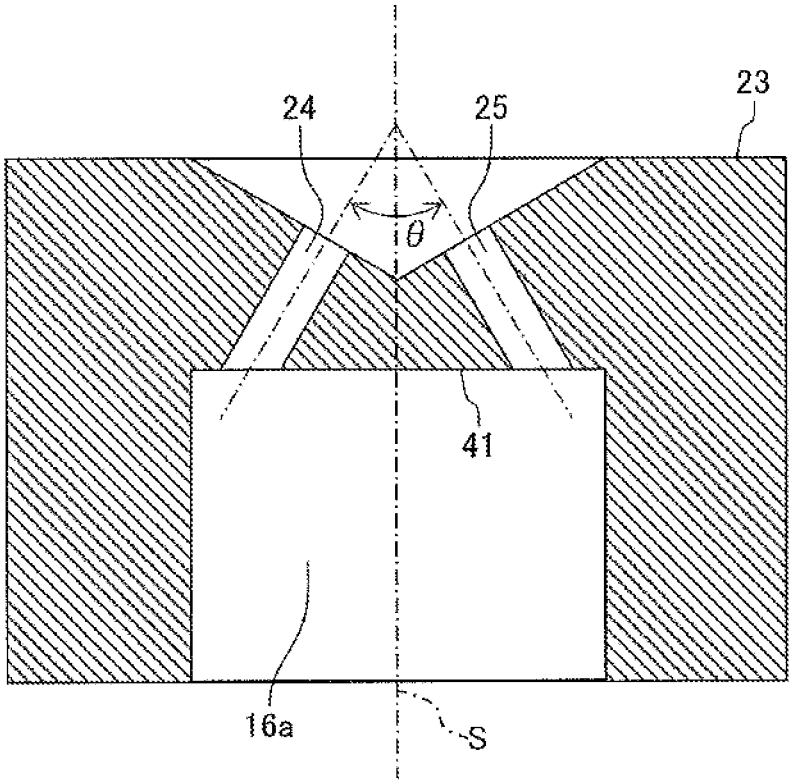
FIG. 4 is an enlarged cross-sectional view of a jet impingement nozzle in FIG. 2.

Next, the jet impingement nozzle 23 is described with reference to a cross-sectional view of FIG. 4. FIG. 4 is an enlarged cross-sectional view of the jet impingement nozzle 23 in FIG. 2. As shown in FIG. 4, the jet impingement nozzle 23 of the fluid supply portion 38 (see FIG. 2) has a bottomed hole **16*a* having a bottom 41 which is axially closer to the compression chamber 13 (see FIG. 2). The jet impingement nozzle 23 includes a first fluid injection hole 24 and a second fluid injection hole 25, with respective axes thereof being inclined at an angle of θ to each other in the same plane to intersect in the compression chamber 13. The first fluid injection hole 24 and the second fluid injection hole 25 each have a smaller hole diameter than the fluid supply hole 16 and are formed in an end of the bottomed hole 16*a*, which is axially closer to the compression chamber 13, that is, in the bottom 41, to communicate with the compression chamber 13 (see FIG. 2**).

The lubricating oil flows through the fluid supply hole 16 via the bottomed hole **16*a* into the first fluid injection hole 24 and the second fluid injection hole 25. The lubricating oil injected through each of the first fluid injection hole 24 and the second fluid injection hole 25 collides with each other, and then is spread in a membrane form over a surface S (surface along the depth direction of the plane of paper in FIG. 4) which is a plane of symmetry between the first fluid injection hole 24 and the second fluid injection hole 25**. The oil membrane gradually becomes thinner as it spreads in the width direction along with advancement, and then is broken, splitted, and atomized.

Figure 5:
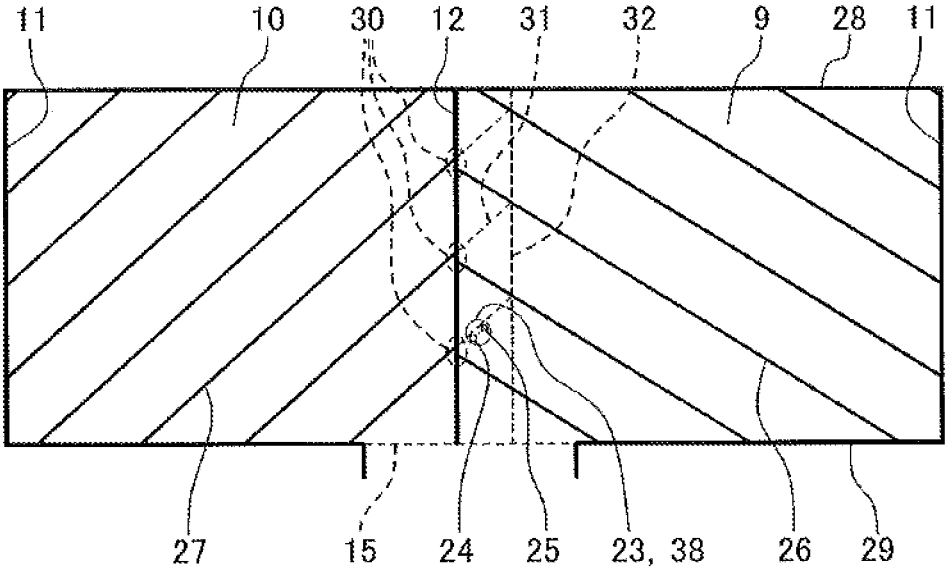
FIG. 5 is a bore development view having a male and female bores developed on a plane centered by a compression cusp.

FIG. 5 is a bore development view having the male bore 9 and the female bore 10 developed on a plane centered by the compression cusp 12. FIG. 5 shows male lobe ridges 26, which are lobe ridges of the male rotor 2 (see FIG. 2), and female lobe ridges 27, which are lobe ridges of the female rotor 3 (see FIG. 2), at a certain moment. The male lobe ridges 26 and the female lobe ridges 27 move in parallel from a suction end surface 28 to a delivery end surface 29, along with the rotation of the male rotor 2 and the female rotor 3.

There is a clearance between the intersection of the male lobe ridge 26 and the compression cusp 12 and the intersection of the female lobe ridge 27 and the compression cusp 12, which serves as an internal leak path between adjacent subspaces of the compression chambers 13 having different pressures (see FIG. 2). This clearance is referred to as a blow hole 30. Similar to the male lobe ridge 26 and the female lobe ridge 27, the blow hole 30 also repeats a cycle of appearing on the suction end surface 28, and then moving toward the delivery end surface 29 and disappearing at the delivery end surface 29, along with the rotation of the male rotor 2 and the female rotor 3 (see FIG. 2).

Figure 6:
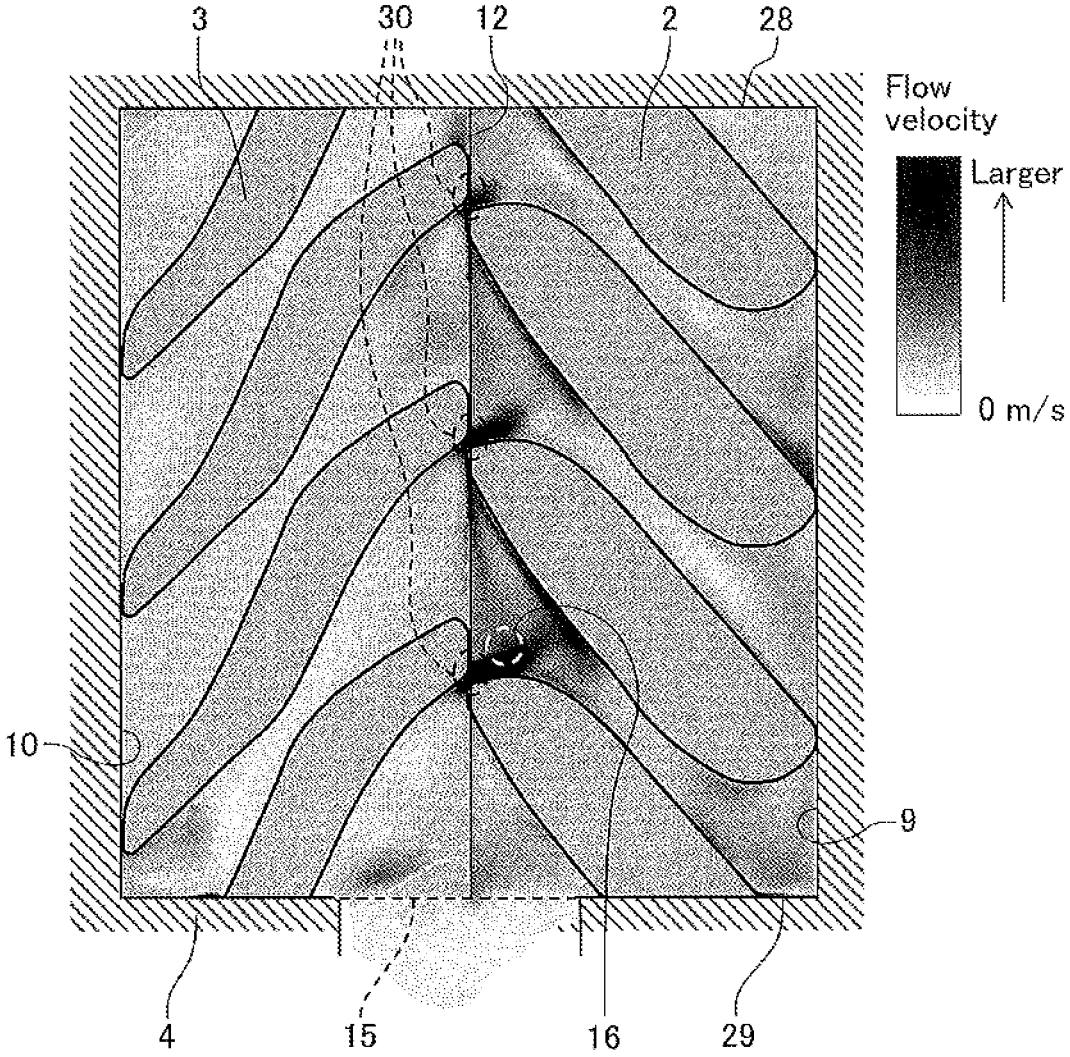
FIG. 6 is a chart illustrating a fluid analysis result on a flow velocity distribution of compressed air in a cross-sectional view taken along a line B-B in FIG. 2.

Next, flowing of the compressed air near the blow hole 30 is described with reference to FIG. 6. FIG. 6 is a chart illustrating a fluid analysis result on the flow velocity distribution of the compressed air in the cross-sectional view taken along a line B-B in FIG. 2. FIG. 6 also shows the position of the fluid supply hole 16 provided in the male bore 9. In FIG. 6, external shapes of the cross-sections of the male rotor 2 and the female rotor 3 are clearly indicated by solid lines for easy understanding. In FIG. 6, the more a region is darkened, the larger the flow velocity in the region is. There are some regions between the blow holes 30 and the male rotor 2 in FIG. 6 where the flow velocity is large. This is because the compressed air leaked through the blow holes 30 to subspaces of the compression chamber 13 in lower pressure (see FIG. 2) expands and is accelerated. Additionally, the compressed air leaked through the blow holes 30 is found to leak along the female lobe ridges 27 (see FIG. 5) to collide with the male rotor 2.

In FIG. 5, a trajectory made by the first intersection of an extension line 31 of the female lobe ridge 27 and the male lobe ridge 26 being moved, along with the rotation of the male rotor 2 and the female rotor 3, is defined as a trajectory line 32. The first intersection is a point where the female lobe ridge 27, when extending toward the male rotor 2, intersects at the first time with the male lobe ridge 26. In this case, the communication portion between the fluid supply hole 16 and the male bore 9, where the jet impingement nozzle 23 is provided, that is, the opening of the fluid supply portion 38 (see FIG. 2) in the compression chamber 13 is positioned between the compression cusp 12 and the trajectory line 32. Additionally, the jet impingement nozzle 23 is set in FIG. 5 such that a straight line connecting the first fluid injection hole 24 and the second fluid injection hole 25 is parallel to the female lobe ridge 27.

The screw compressor 100 according to the present embodiment is basically configured as described above. Next, advantageous effects of the screw compressor 100 is described.

The screw compressor 100 includes the screw rotor 1, the casing 4, and the fluid supply portion 38 to supply fluid in a membrane form into the compression chamber 13 defined in the casing 4, as shown in FIG. 2. The screw rotor 1 has the male rotor 2 and the female rotor 3. The casing 4 is formed on the inner surface thereof with the male bore 9 to cover the male rotor 2 and the female bore 10 to cover the female rotor 3. Here, the higher pressure intersection line of the male bore 9 and the female bore 10 is defined as the compression cusp 12. Additonally, in the bore development view in FIG. 5, the trajectory made by the first intersection of the extension line 31 of the female lobe ridge 27 and the male lobe ridge 26 being moved, along with the rotation of the male rotor 2 and the female rotor 3 (see FIG. 2, the same is applied hereinafter), is defined as the trajectory line 32. In this case, the opening of the fluid supply portion 38 in the compression chamber 13 (see FIG. 2, the same is applied hereinafter) is positioned between the compression cusp 12 and the trajectory line 32.

In such a configuration, the compressed air leaked through the blow holes 30 is accelerated and then interferes with the oil membrane flowing out through the fluid supply portion 38 (jet impingement nozzle 23). Fluid is generally liable to be split and broken in proportion to the square of the velocity difference from the surrounding gas. Therefore, interference with the compressed air flowing at a high velocity promotes atomization of the oil membrane flowing out through the fluid supply portion 38, even if the oil membrane is not spread wide enough.

This decreases the distance from a point where the fluid membrane is formed to a point where the fluid is atomized. For this reason, sufficiently atomized lubricating oil is supplied to the compression chamber 13, even when the space required for atomization is not sufficiently secured in a small-sized compressor or the velocity difference between air and lubricating oil is small due to a slow rotation speed of the screw rotor 1 (see FIG. 2).

Besides, the fluid supply portion 38 is positioned closer to the compression cusp 12 than the trajectory line 32. This allows for preventing the compressed air leaked through the blow hole 30 from colliding with the male rotor 2 before interfering with the oil membrane flowing out through the fluid supply portion 38. In contrast, if the fluid supply portion 38 is positioned on the compression cusp 12, the effect of promoting atomization of the lubricating oil through interference with the compressed air is small because the leaking compressed air is not accelerated.

According to the present embodiment, the fluid supplied to the compression chamber 13 from the outside of the screw compressor 100 (see FIG. 1) via the fluid supply portion 38 is sufficiently atomized in a shorter distance from the fluid supply portion 38, as described above.

In addition, not only the distance required for atomizing the lubricating oil is shortened, but also the particle diameter of the lubricating oil is reduced, so that the heat transfer area between the compressed air and the lubricating oil is increased to promote the cooling effect of air in the compression process. Additionally, the reduced particle diameter of the lubricating oil causes a particle of the lubricating oil to have reduced mass and therefore to be easily affected by the flow of the compressed air. The lubricating oil atomized by the compressed air flowing at a high velocity is then spread over a wider range. This makes heat exchanged between the compressed air and the lubricating oil in a wider range. Moreover, the lubricating oil seals the internal clearance of the compression chamber 13 over a wider range, to suppress internal leaks of the compressed gas. As a result, power of the screw compressor 100 is reduced to achieve energy saving.

Further, in the present embodiment, the fluid supply portion 38 includes the fluid injection holes 24 and 25, with respective axes thereof being inclined to each other in the same plane to intersect in the compression chamber 13, as shown in FIG. 4. In this configuration, the fluid injected from the respective fluid injection holes 24 and 25 collides with each other, and then spreads in a membrane form over the plane S which is a plane of symmetry between the fluid injection holes 24 and 25. Therefore, the fluid supply portion 38 uses a compact configuration to supply fluid in a membrane form into the compression chamber 13.

Furthermore, the jet impingement nozzle 23 of the fluid supply portion 38 is attached in FIG. 5 such that a straight line connecting the first fluid injection hole 24 with the second fluid injection hole 25 is parallel to the female lobe ridge 27. As a result, the oil membrane flowing out of the jet impingement nozzle 23 spreads over the plane S (see FIG. 4) orthogonal to the extension line 31. The compressed air leaking through the blow holes 30 flows along the female lobe ridge 27, and thus the leaked compressed air collides with the oil membrane orthogonally to the width direction of the latter. Therefore, the velocity difference and interference area between the oil membrane and the compressed air are both peaked, to promote the fluid membrane being further broken and split. However, the width direction of the fluid in a membrane form supplied from the fluid supply portion 38 being spread may be set to any direction between the axial direction of the male rotor 2 and the direction along the male lobe ridge 26. Even with such a configuration, the velocity difference and interference area between the oil membrane and the compressed air are both increased, to promote the fluid membrane being broken and split.

Second Embodiment

Figure 7:
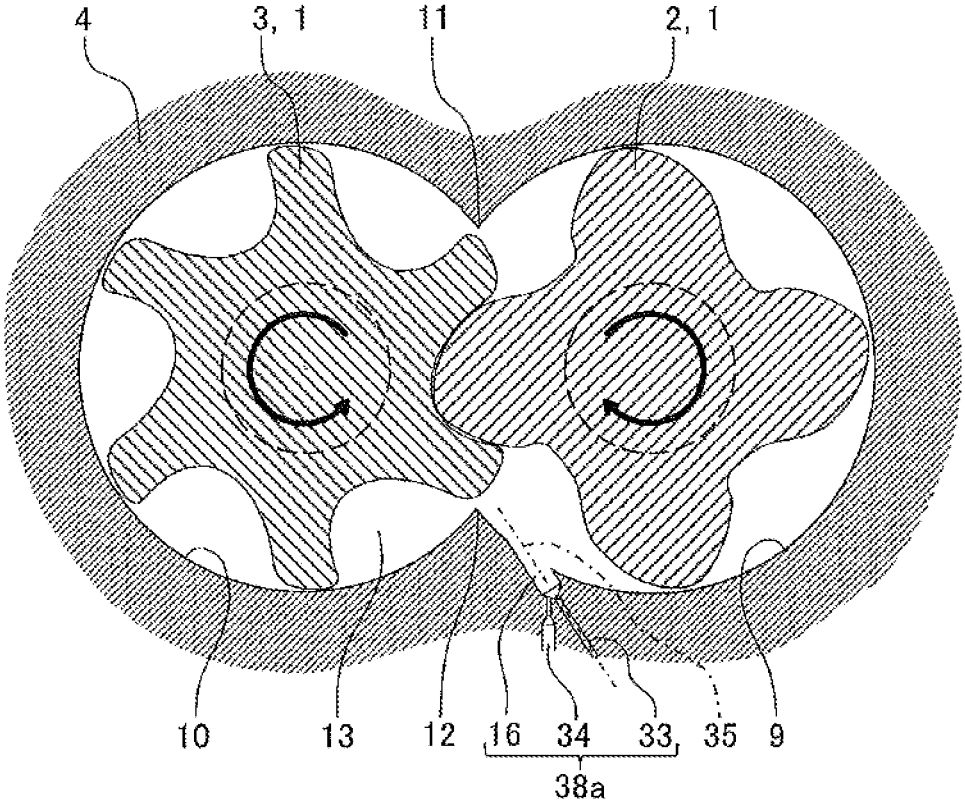
FIG. 7 is a cross-sectional view of a screw rotor and the vicinity of a fluid supply portion, according to a second embodiment.
Figure 8:
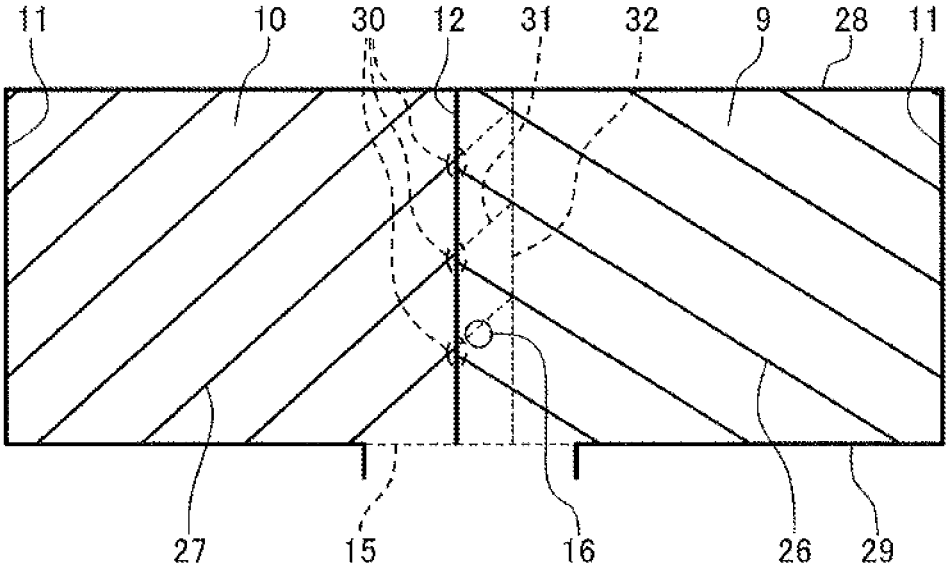
FIG. 8 is a bore development view having a male and female bores, according to the second embodiment, developed on a plane centered by a compression cusp.

Next, a second embodiment of the present invention is described with reference to FIGS. 7 and 8, focusing on differences from the first embodiment, and descriptions of common features are omitted. FIG. 7 is a cross-sectional view of the screw rotor 1 and the vicinity of a fluid supply portion 38*a*, according to the second embodiment. FIG. 8 is a bore development view having the male bore 9 and the female bore 10, according to the second embodiment, developed on a plane centered by the compression cusp 12.

The second embodiment differs from the first embodiment in FIG. 2 on the point that a lubricating oil supply passage 33 and a compressed air supply portion 34 are each connected upstream of the fluid supply hole 16, as shown in FIG. 7. The fluid supply hole 16, the lubricating oil supply passage 33, and the compressed air supply portion 34 constitute the fluid supply portion 38*a* according to the second embodiment.

The lubricating oil flowing into the fluid supply hole 16 through the lubricating oil supply passage 33 is mixed with the compressed air flowing from the compressed air supply portion 34, and then atomized, as shown in FIGS. 7 and 8. That is, the fluid supply portion 38*a* causes the lubricating oil to be atomized before being supplied into the compression chamber 13 defined in the casing 4. The atomized lubricating oil then interferes with the compressed air leaking through the blow hole 30, when flowing into the compression chamber 13 from the fluid supply hole 16, to further promote atomization of the lubricating oil so that the particle diameter thereof is reduced.

In addition, the particle diameter of the lubricating oil being reduced has the same advantageous effects as those of the first embodiment. That is, the cooling effect of the compressed air is promoted, the lubricating oil is spread over a wider range to have heat exchange in a wider range, and the internal clearance is sealed over a wider area, to achieve energy saving of the screw compressor 100.

Further, fluid is supplied from the fluid supply portion 38*a* in such an inclined direction that the forefront comes closer to the female rotor 3 than a starting end of the supplied fluid, as shown in FIG. 7. That is, a center axis 35 of the fluid supply hole 16 is inclined toward the female rotor 3. For this reason, the direction of the compressed air being leaked through the blow holes 30 and the direction of the lubricating oil being injected through the fluid supply hole 16 are in a more countercurrent relationship with each other. This increases the velocity difference between the lubricating oil flowing out of the fluid supply portion 38*a* and the compressed air leaking through the blow holes 30, to further promote atomization of the lubricating oil. Note that fluid may be supplied from the fluid supply portion 38 in such an inclined direction that the forefront comes closer to the female rotor 3 than a starting end of the supplied fluid, also in the first embodiment as described above.

Third Embodiment

Figure 9:
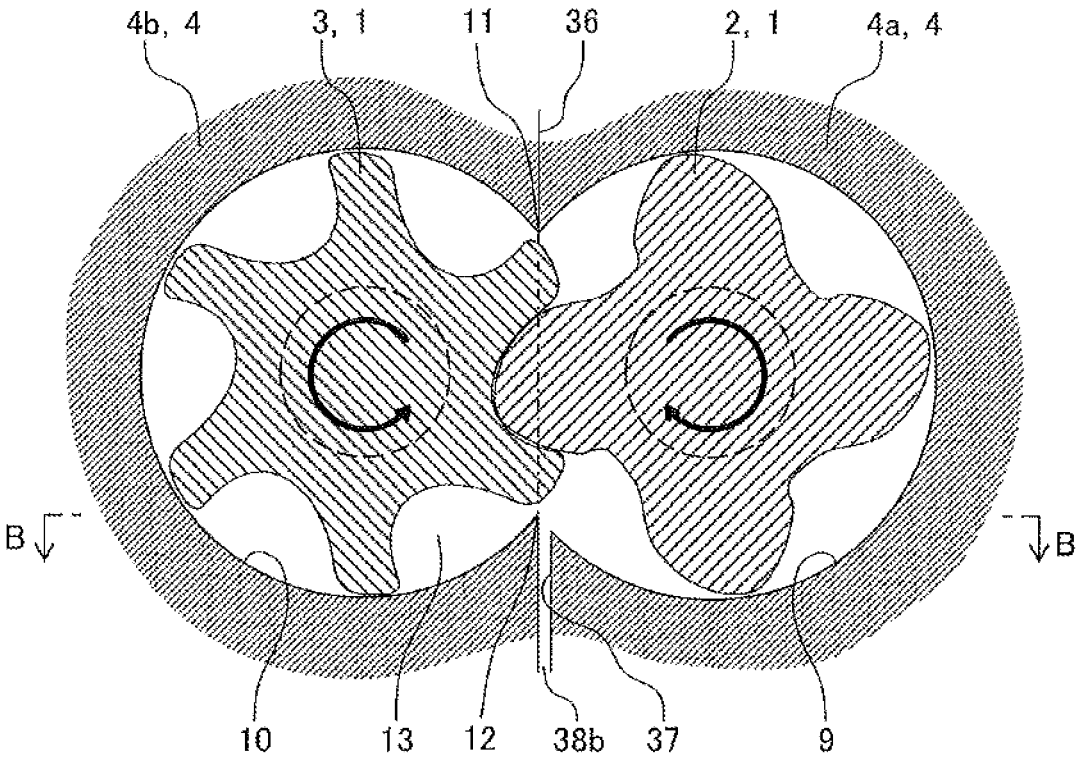
FIG. 9 is a cross-sectional view of a screw rotor and the vicinity of a fluid supply portion, according to a third embodiment.
Figure 10:
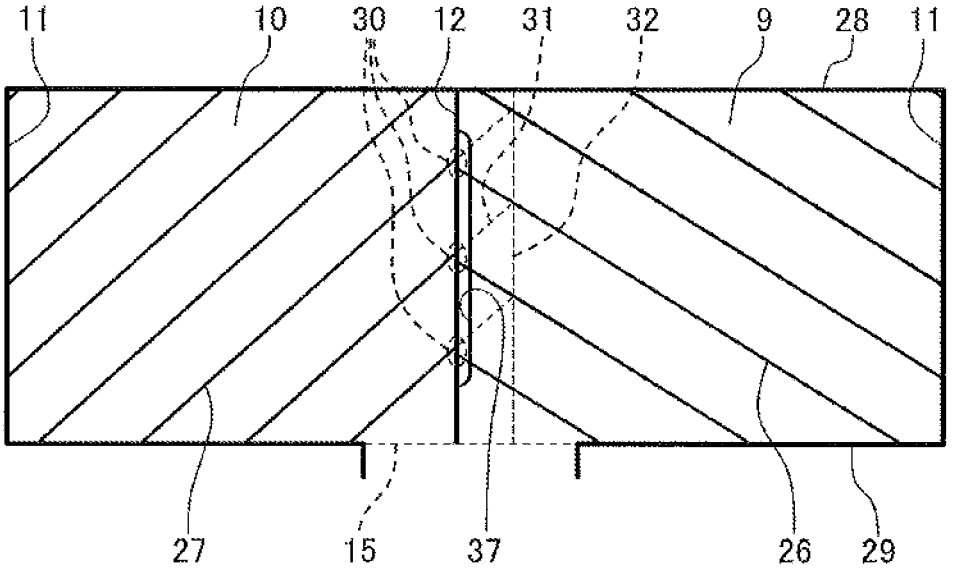
FIG. 10 is a bore development view having a male and female bores, according to the third embodiment, developed on a plane centered by a compression cusp.

Next, a third embodiment of the present invention is described with reference to FIGS. 9 and 10, focusing on differences from the first embodiment, and descriptions of common features are omitted. FIG. 9 is a cross-sectional view of the screw rotor 1 and the vicinity of a fluid supply portion 38*b*, according to the third embodiment. FIG. 10 is a bore development view having the male bore 9 and the female bore 10, according to the third embodiment, developed on a plane centered by the compression cusp 12.

The third embodiment is different from the first embodiment in FIG. 2 on the point that the casing 4 is divided into a male casing 4*a* and a female casing 4*b* by a plane containing the suction cusp 11 and the compression cusp 12.

A division surface 36 of the male casing 4*a*, which contains the compression cusp 12, is provided with a recess 37, as shown in FIGS. 9 and 10. The male casing 4*a* and the female casing 4*b* coming in contact on the division surface 36 with each other causes the recess 37 to define the fluid supply portion 38*b* as a slit-shaped passage. That is, the fluid supply portion 38*b* is formed of a passage surrounded by the inner surface of the recess 37 and the division surface 36 of the female casing 4*b*.

The lubricating oil flowing from the outside of the casing 4 into the fluid supply portion 38*b*, as slit-shaped passage, flows from the passage, in a membrane form, into the compression chamber 13. The lubricating oil in a membrane form (oil membrane) then interferes with the compressed air leaking through the blow holes 30, is broken and split, and is atomized. With the recess 37 defining the passage for the lubricating oil provided on the division surface 36 of the male casing 4*a*, an oil membrane is formed over a wide range from the suction end surface 28 to the delivery end surface 29. Then, the oil membrane is made to interfere with the compressed air leaking through the blow holes 30, to supply the atomized lubricating oil into the entire compression chamber 13.

Incidentally, it is generally difficult and requires large machining costs to machine a passage, which has a width of 1 mm or less and is long in the depth direction, using a tool such as an end mill. In contrast, the above-described method of machining the recess 37 in the division surface 36 of the male casing 4*a*, and making the division surface 36 of the female casing 4*b* serve as one of the inner wall surfaces of the passage does not require large machining costs. Accordingly, extremely thin oil membranes are formed at low cost in wide areas in the compression chamber 13 near the blow holes 30. The extremely thin oil membranes are then made to interfere with the compressed air leaking through the blow holes 30, to make the oil membranes sufficiently atomized in a short distance from the communication portion between the fluid supply portion 38*b* and the compression chamber 13. This achieves energy saving of the screw compressor 100.

Hereinabove, the present invention has been described based on the embodiments, but the present invention is not limited thereto and includes various modifications. For example, the embodiments have been described in detail for the purpose of illustrating the present invention, and the present invention is not necessarily limited to those having all the configurations described above. The configurations of the embodiments may partly be deleted, or added or replaced with another configuration.

For example, in the above-described embodiments, the fluid supplied from the outside of the screw compressor 100 into the compression chamber 13 is lubricating oil, but is not limited thereto and fluid such as water or coolant may be used.

In addition, in the above-described embodiments, air is described as an example of an object to be compressed, but another gas such as nitrogen may be used.

LIST OF REFERENCE SIGNS

1: screw rotor, 2: male rotor, 3: female rotor, 4: casing, 4*a*: male casing, 4*b*: female casing, 9: male bore, 10: female bore, 11: suction cusp, 12: compression cusp (compression intersection), 13: compression chamber, 16 fluid supply hole, 23: jet impingement nozzle, 24: first fluid injection hole, 25: second fluid injection hole, 26: male lobe ridge, 27: female lobe ridge, 31: extension line, 32: trajectory line, 33: lubricating oil supply passage, 34: compressed air supply portion, 36: division surface, 37: recess, 38, 38*a*, 38*b*: fluid supply portion, and 100: screw compressor.

The invention claimed is:

1. A screw compressor comprising:

a screw rotor;

a casing to house the screw rotor; and a fluid supply portion to supply fluid into a compression chamber defined in the casing, wherein the screw rotor has a male and female rotors that have twisted lobes and are rotated while meshing with each other, the casing is formed on the inner surface thereof with a male bore in a cylindrical shape to cover the male rotor and a female bore in a cylindrical shape to cover the female rotor, and when an intersection line, on a higher pressure side, of the male and female bores is defined as a compression intersection line, and in a bore development view having the male and female bores developed on a plane, a trajectory made by a first intersection of an extension line of the lobe ridge of the female rotor and the lobe ridge of the male rotor being moved, along with the rotation of the male and female rotors, is defined as a trajectory line, an opening position of the fluid supply portion in the compression chamber is present only between the compression intersection line and the trajectory line.

2. A screw compressor comprising:

a screw rotor;

a casing to house the screw rotor; and a fluid supply portion to supply fluid in an atomized form into a compression chamber defined in the casing, wherein the screw rotor has a male and female rotors that have twisted lobes and are rotated while meshing with each other, the casing is formed on the inner surface thereof with a male bore in a cylindrical shape to cover the male rotor and a female bore in a cylindrical shape to cover the female rotor, and when an intersection line, on a higher pressure side, of the male and female bores is defined as a compression intersection line, and in a bore development view having the male and female bores developed on a plane, a trajectory made by a first intersection of an extension line of the lobe ridge of the female rotor and the lobe ridge of the male rotor being moved, along with the rotation of the male and female rotors, is defined as a trajectory line, an opening position of the fluid supply portion to the compression chamber is present only between the compression intersection line and the trajectory line.

3. The screw compressor as claimed in claim 1, wherein the fluid supply portion includes fluid injection holes, with respective axes thereof being inclined to each other in the same plane to intersect in the compression chamber.

4. The screw compressor as claimed in claim 1, wherein the width direction of the fluid supplied from the fluid supply portion being spread is set to spread in any direction between the axial direction of the male rotor and the direction along a male lobe ridge of the male rotor.

5. The screw compressor as claimed in claim 1, wherein the casing is divided into two by a plane containing two intersection lines of the male and female bores, a division surface of one part of the casing to contain the compression intersection line is provided with a recess, and the fluid supply portion is formed of a passage surrounded by the inner surface of the recess and a division surface of the other part of the casing.

6. The screw compressor as claimed in claim 1, wherein fluid is supplied from the fluid supply portion in such an inclined direction that the forefront comes closer to the female rotor than a starting end of the supplied fluid.

7. The screw compressor as claimed in claim 2, wherein fluid is supplied from the fluid supply portion in such an inclined direction that the forefront comes closer to the female rotor than a starting end of the supplied fluid.

* * * * *